US009453407B2

(12) United States Patent
Hedtke et al.

(10) Patent No.: US 9,453,407 B2
(45) Date of Patent: Sep. 27, 2016

(54) DETECTION OF POSITION OF A PLUNGER IN A WELL

(71) Applicant: Rosemount Inc., Chanhassen, MN (US)

(72) Inventors: Robert Carl Hedtke, Young America, MN (US); Nathan Len Wiater, Victoria, MN (US)

(73) Assignee: Rosemount Inc., Chanhassen, MN (US)

( * ) Notice: Subject to any disclaimer, the term of this patent is extended or adjusted under 35 U.S.C. 154(b) by 709 days.

(21) Appl. No.: 13/630,783

(22) Filed: Sep. 28, 2012

(65) Prior Publication Data

US 2014/0090837 A1 Apr. 3, 2014

(51) Int. Cl.

| | |
|---|---|
| ***E21B 47/09*** | (2012.01) |
| ***E21B 43/12*** | (2006.01) |
| ***F04B 47/02*** | (2006.01) |
| ***F04B 49/06*** | (2006.01) |
| ***F04B 51/00*** | (2006.01) |

(52) U.S. Cl.

CPC ..... *E21B 47/091* (2013.01); *E21B 43/121* (2013.01); *E21B 47/09* (2013.01); *F04B 47/02* (2013.01); *F04B 49/06* (2013.01); *F04B 51/00* (2013.01)

(58) Field of Classification Search

CPC .... E21B 47/091; E21B 43/121; E21B 47/09; E21B 43/12; E21B 47/14

See application file for complete search history.

(56) References Cited

U.S. PATENT DOCUMENTS

| | | | | |
|---|---|---|---|---|
| 2,322,343 | A * | 6/1943 | Brandon | E21B 47/09 200/61.4 |
| 3,863,714 | A | 2/1975 | Watson, Jr. | |
| 4,961,441 | A | 10/1990 | Salter | |
| 4,989,671 | A | 2/1991 | Lamp | |
| 5,314,016 | A | 5/1994 | Dunham | |
| 5,526,883 | A | 6/1996 | Breaux | |
| 5,636,693 | A | 6/1997 | Elmer | |
| 5,753,812 | A | 5/1998 | Aron et al. | |
| 5,785,123 | A | 7/1998 | Lea, Jr. | |
| 5,826,659 | A | 10/1998 | Hershberger | |
| 5,878,817 | A | 3/1999 | Stastka | |
| 5,957,200 | A | 9/1999 | Majek et al. | |

(Continued)

FOREIGN PATENT DOCUMENTS

| | | |
|---|---|---|
| CN | 1165956 | 11/1997 |
| CN | 1445434 | 10/2003 |

(Continued)

OTHER PUBLICATIONS

International Search Report and Written Opinion dated Sep. 11, 2014 for corresponding International Application No. PCT/US2013/060540, filed Sep. 19, 2013.

(Continued)

*Primary Examiner* — Shane Bomar
*Assistant Examiner* — Wei Wang
(74) *Attorney, Agent, or Firm* — Westman, Champlin & Koehler, P.A.

(57) ABSTRACT

A system for identifying location of a plunger that moves along a length of a well, includes an acoustic source carried in the well configured to transmit an acoustic signal when the plunger reaches a sense location in the well. An acoustic receiver is positioned at a top of the well and is configured to receive the acoustic signal processing circuitry processes the received acoustic signal and provides an output indicative of the plunger reaching the sense location.

27 Claims, 5 Drawing Sheets

(56) References Cited

U.S. PATENT DOCUMENTS

| | | | | |
|---|---|---|---|---|
| 5,984,013 | A | 11/1999 | Giacomino et al. | |
| 5,987,385 | A | 11/1999 | Varsamis | |
| 6,196,324 | B1 | 3/2001 | Giacomino et al. | |
| 6,241,014 | B1 | 6/2001 | Majek et al. | |
| 6,464,011 | B2 | 10/2002 | Tubel | |
| 6,595,287 | B2 | 7/2003 | Fisher | |
| 6,634,426 | B2 | 10/2003 | McCoy et al. | |
| 6,705,404 | B2 | 3/2004 | Bosley | |
| 6,719,060 | B1 | 4/2004 | Wells | |
| 6,830,108 | B2 | 12/2004 | Rogers, Jr. | |
| 6,883,606 | B2 | 4/2005 | Evans et al. | |
| 6,907,926 | B2 | 6/2005 | Bosley | |
| 6,966,366 | B2 | 11/2005 | Rogers, Jr. | |
| 7,004,258 | B2 | 2/2006 | Farris | |
| 7,040,401 | B1 | 5/2006 | McCannon | |
| 7,099,780 | B2 | 8/2006 | Faur et al. | |
| 7,219,725 | B2 | 5/2007 | Chisholm | |
| 7,597,143 | B2 | 10/2009 | Giacomino | 166/250.11 |
| 7,690,425 | B2 | 4/2010 | Giacomino | 166/250.11 |
| 7,819,189 | B1 | 10/2010 | Cosby | |
| 7,963,326 | B2 | 6/2011 | Giacomino | |
| 8,176,998 | B2 | 5/2012 | Brostom | |
| 2005/0178543 | A1 | 8/2005 | Giacomino | |
| 2008/0110617 | A1 | 5/2008 | Giacomino | |
| 2009/0200020 | A1 | 8/2009 | Hearn | |
| 2009/0258618 | A1 | 10/2009 | Moroni | |
| 2012/0092960 | A1 | 4/2012 | Gaston et al. | |
| 2012/0193091 | A1* | 8/2012 | Bender | F04B 47/12 166/250.15 |
| 2014/0048158 | A1 | 2/2014 | Baca | |
| 2014/0102698 | A1 | 4/2014 | Bergman | |

FOREIGN PATENT DOCUMENTS

| | | |
|---|---|---|
| CN | 101469609 | 7/2009 |
| CN | 102057130 | 5/2011 |
| CN | 102518427 | 6/2012 |
| EP | 1 830 035 | 5/2007 |
| RU | 2153055 | 7/2000 |
| RU | 2462592 | 9/2012 |
| WO | WO 02/29197 A2 | 4/2002 |

OTHER PUBLICATIONS

Dieter Joseph Becker et al., "Plunger Lift Optimization by Monitoring and Analyzing Wellbore Acoustic Signals and Tubing and Casing Pressures", Oct. 1, 2006, pp. 11-13, XP055139529.

Notification of Transmittal of the International Search Report and Written Opinion from International Application No. PCT/US2014/050509, dated Apr. 8, 2015.

Office Action from Australian Patent Application No. 2013323937, dated Sep. 11, 2015.

Office Action from Chinese Patent Application No. 201210509974.3, dated Oct. 16, 2015.

Office Action from U.S. Appl. No. 14/039,625, dated Dec. 31, 2015.

Communication pursuant to Rule 161(1) and 162 EPC from European Patent Application No. 13770606.5, dated Jul. 17, 2015, 2 pages.

Examination Report from Australian Patent Application No. 2013323937, dated Mar. 3, 2016.

Second Office Action for Chinese Patent Application No. 201210509974.3, dated Apr. 28, 2016, 12 pages.

Office Action for Russian Patent Application No. 2015115968, dated Jun. 9, 2016.

* cited by examiner

DETECTION OF POSITION OF A PLUNGER IN A WELL

BACKGROUND

The present invention relates to plungers of the type which are used to remove liquid from a natural gas well or the like. More specifically, the invention relates to detecting position of the plunger as it moves along a length of the well.

Deep wells are used to extract gas and liquids from within the ground. For example, such wells are used to extract natural gas from underground gas pockets. The well comprises a long tube which is placed in a hole which has been drilled into the ground. When the well reaches a pocket of natural gas, the gas can be extracted to the surface.

As a natural gas well ages, liquid such as water tends to collect at the bottom of the well. This water slows, and eventually prevents, the natural gas from flowing to the surface. One technique which has been used to extend the lives of well is a plunger-based lift system which is used to remove the liquid from the bottom of the well. Position of the plunger within the well is controlled by opening and closing a valve at the top of the well. When the valve is closed, flow of gas out of the well is stopped and the plunger falls through the water to the bottom of the well. When the plunger reaches the bottom of the well, the valve can be opened whereby pressure from within the well pushes the plunger to the surface. As the plunger rises, it lifts any liquid which is above it up to the surface thereby removing most of the liquid from the well.

In order to efficiently operate the plunger, it is desirable to identify when the plunger reaches the bottom of the well. Various techniques have been used to determine when the plunger reaches the bottom of the well, for example, U.S. Pat. No. 7,963,326, issued Jun. 21, 2011, entitled "Method and Apparatus for Utilizing Pressure Signature in Conjunction with Fall Time as Indicator in Oil and Gas Wells" to Giacomino describes one technique.

SUMMARY

A system for identifying location of a plunger that moves along a length of a well, includes an acoustic source carried in the well configured to transmit an acoustic signal when the plunger reaches a sense location in the well. An acoustic receiver is positioned at a top of the well and is configured to receive the acoustic signal processing circuitry processes the received acoustic signal and provides an output indicative of the plunger reaching the sense location.

DETAILED DESCRIPTION OF ILLUSTRATIVE EMBODIMENTS

The present invention provides a system for identifying a location of a plunger as it moves along a length of a well such as a natural gas well. More specifically, with the present invention an acoustic source is carried within the well and is configured to transmit an acoustic signal from a sense location in the well when the plunger reaches the sense location. The acoustic signal is received by an acoustic receiver and is used to determine that the plunger has reached the sense location. In one configuration, the acoustic source is positioned at the sense location. When the plunger reaches the sense location, the plunger strikes the acoustic source causing the acoustic source to vibrate thereby creating the acoustic signal. The acoustic signal can be coupled to piping of the well which is thereby used to carry the acoustic signal to the surface. In another configuration, the plunger may carry a "clapper" which is used to strike an object at the sense location or strike the well piping when the plunger reaches the sense location. Typically, the sense location is located at or near the bottom of the well.

When a natural gas well first begins its operation, gas typically flows freely from below ground to the surface, aided by a high pressure usually present in the reservoir. However, during the life of the well, water begins to flow into the bottom of a gas well. The resulting back-pressure of the water column, coupled with a decrease in the reservoir pressure causes the flow of natural gas to slow, and eventually stop completely.

One solution to this problem is to shut the well in (closing a valve at the well head) allowing the pressure in the reservoir to build up again. When the pressure builds up sufficiently, the valve is opened again, and the built-up pressure pushes the water to the top. However, the drawback of this approach is that a large amount of the water falls back to the bottom of the well, and in the end, the well doesn't gain much additional gas production.

Figure 1:
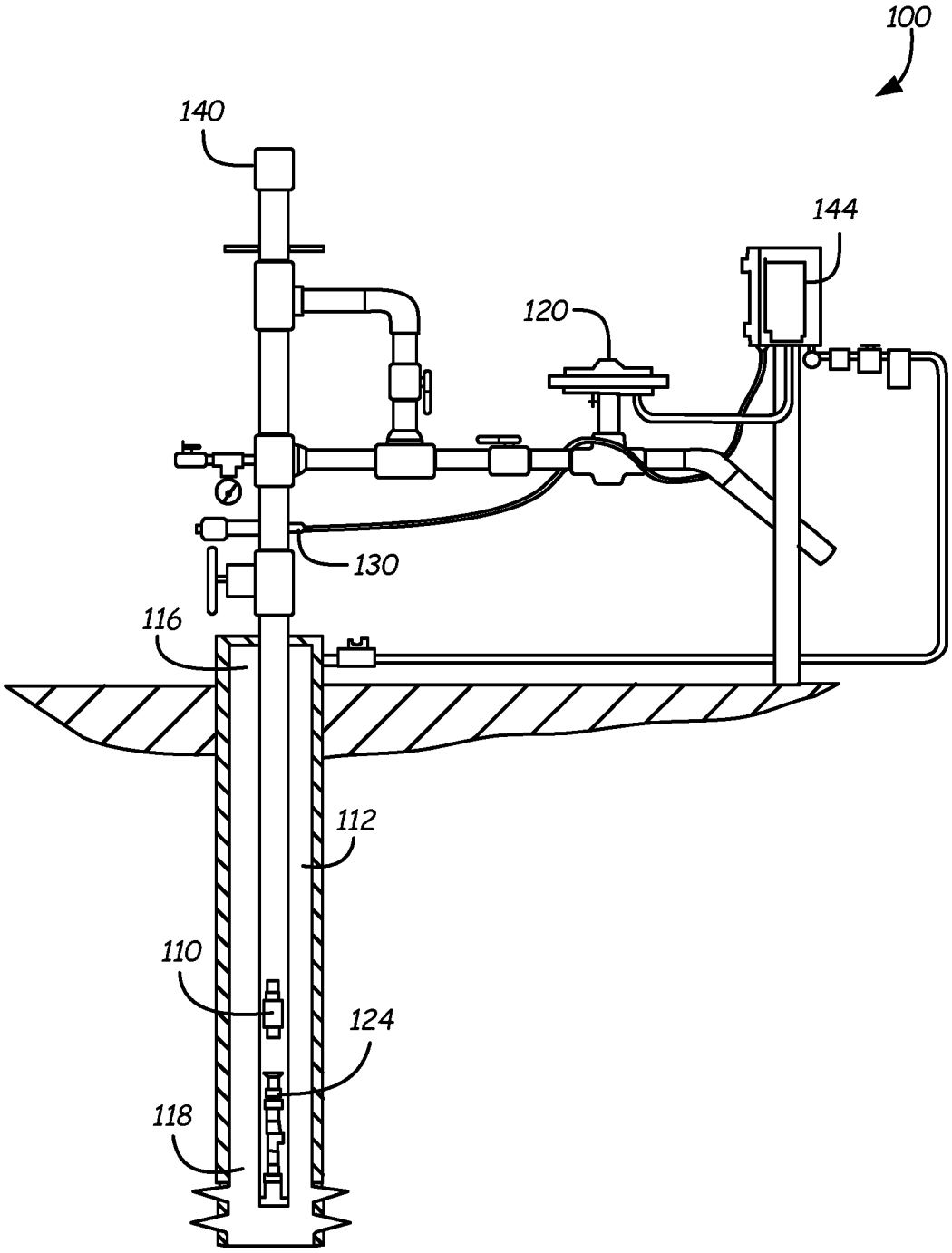
FIG. 1 is a simplified view of a well employing the system for identifying a location of a plunger in accordance with the present invention.

A better solution, and the one that is most commonly used in gas wells, is to use a plunger to lift the water out of the well. FIG. 1 illustrates a typical gas well 100 with a plunger lift system. The plunger 110 is a device approximately the same diameter as the center tubing 112 of the well 100, which freely moves up and down the well. A motor valve 120 is used to open and close the well, causing the plunger 110 to travel to the top 116 or bottom 118 of the well, as described below. At the bottom 118 of the well is a bumper spring 124, which prevents damage to the plunger 110 when it hits bottom 118. At the well head is the catcher and arrival sensor 130 which catches the plunger 110 when it comes to the top 116 of the well, and generates an electronic signal indicating the arrival of the plunger 110. Above the catcher is the lubricator 140, which applies an oil, or other lubricant to the plunger 110, ensuring that it will move through the tubing freely. The electronic controller 144 operates the well by receiving available measurement signals (e.g. tubing pressure and plunger arrival), and by sending commands to the motor valve 120 to open and close at the appropriate time.

Plunger assemblies used for lifting the well's fluid production to the surface operate as very long stroking pumps. The plunger 110 is designed to serve as a solid interface between the fluid column and the lifting gas. When the plunger 110 is travelling, there is a pressure differential across the plunger 110 which will inhibit any fluid fallback. Therefore, the amount delivered to the surface should be virtually the same as the original load. The plunger 110 travels from bottom 118 to top 116, acting as a swab, removing liquids in the tubing string. There are many types of plungers which are available.

The plunger 110 itself may take various forms. Some plungers include spring loaded expanding blades which seal against the tubing walls of the well to create pressure differential for the upwards stroke. Other types of plungers include plungers with labyrinth rings to provide sealing, plungers with an internal bypass which allows the plunger to fall more rapidly, etc.

Because a gas producer may operate thousands of wells, the instrumentation and control on any given well is typically very minimal. In some instances, the only measurements that may be made on the well are made with two absolute pressure transmitters, one measuring the tubing pressure (the center tube through which the plunger falls, and through which gas normally flows) and the other measuring the casing pressure (also called the annulus—an outer void containing the tubing). Motor valve 120 opens and closes to control the plunger 110 falling to the bottom 118 of the well 100, or coming to the top 116, and the electric controller 144, often a Programmable Logic Controller (PLC) or Remote Operator Console (ROC). The controller 144 receives the available measurement signals, and opens and closes the motor valve 120 at the appropriate time, in order to keep the well operating optimally. In some configurations, there may also be a plunger arrival sensor (which senses when the plunger reaches the well head), a temperature measurement sensor or a flow rate sensor. Whichever of these measurements are present, they are all measurements made at the top of the well. There is typically no permanent instrumentation or measurement within or at the bottom of a well. Thus, the controller 144 needs to perform the plunger cycle control based only upon these measurements at the well head.

One of the important aspects of gas control with plunger lift is that the well must be shut in for an appropriate length of time. Specifically, the well must be shut in long enough for the plunger to reach the bottom. If the plunger does not get all the way to the bottom, then when the motor valve is opened not all of the water will be removed, and the well will not return to optimal production. If this occurs, the time that it took for the plunger to fall and return (which could be 30 minutes or longer) will have been wasted. Even more critical is that if the motor valve is opened before the plunger hits any water, then without the water to slow down the plunger, the speed of the plunger coming up (caused by the large pressure within the well) may be so great that it will damage the plunger or lubricator/catcher, or even blow the catcher completely off the well head.

Because of the danger of bringing the plunger back up too early, most well control strategies will have a built-in "safety factor". They will shut the well in long enough for the plunger to reach the bottom, plus some additional time, just to ensure that the plunger does reach the bottom. The disadvantage here is that time the plunger is sitting on the bottom is time that the gas well is not producing. The longer the plunger has to sit on the bottom, the longer it will be before the gas well can return to full production.

Various techniques are employed to detect when the plunger reaches the bottom of the well. For example, pressure and acoustic signals can be monitored, however, they are often small and difficult to identify due to the amount of background noise, the extended length of the well, and loss of signal as they flow through the liquid and gas in the well. One such technique is shown in U.S. Pat. No. 7,963,326 entitled METHOD AND APPARATUS FOR UTILIZING PRESSURE SIGNATURE IN CONJUCTION WITH FALL TIME AS INDICATOR IN OIL AND GAS WELLS, issued Jun. 21, 2011 to Production Control Services, Inc.

Figure 2:
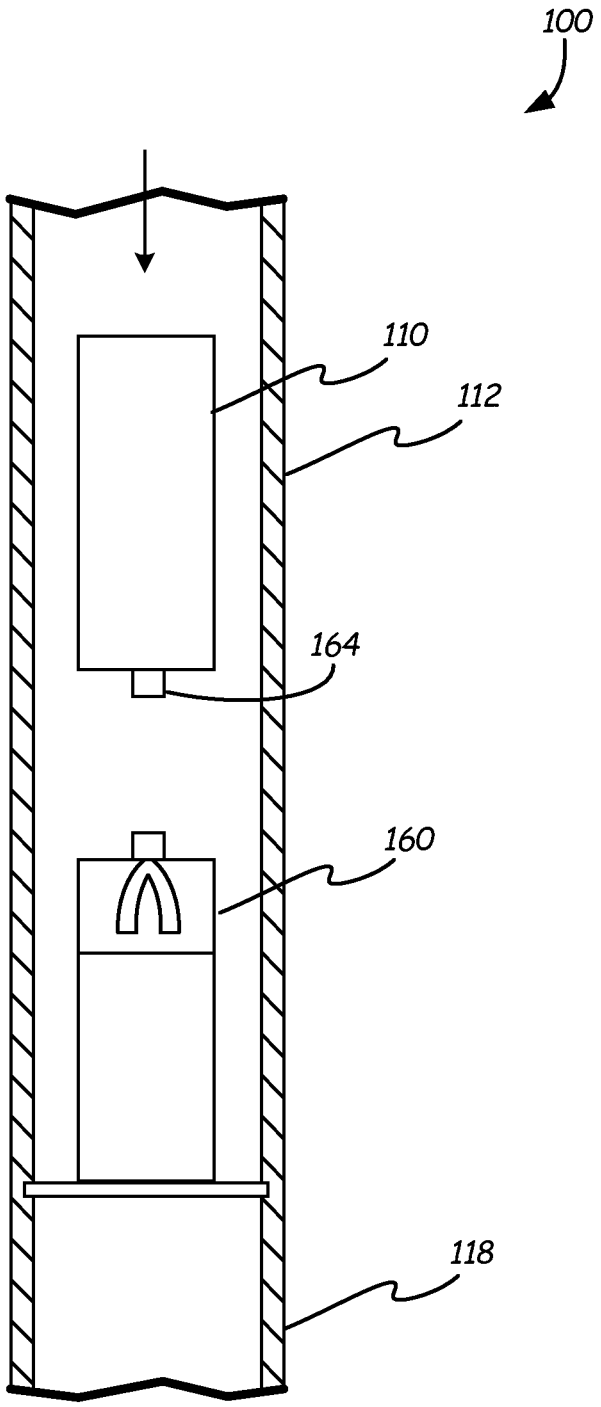
FIG. 2 is a cross-sectional view of a bottom of the well of FIG. 1 illustrating an acoustic source in accordance with one embodiment of the present invention.
Figure 3:
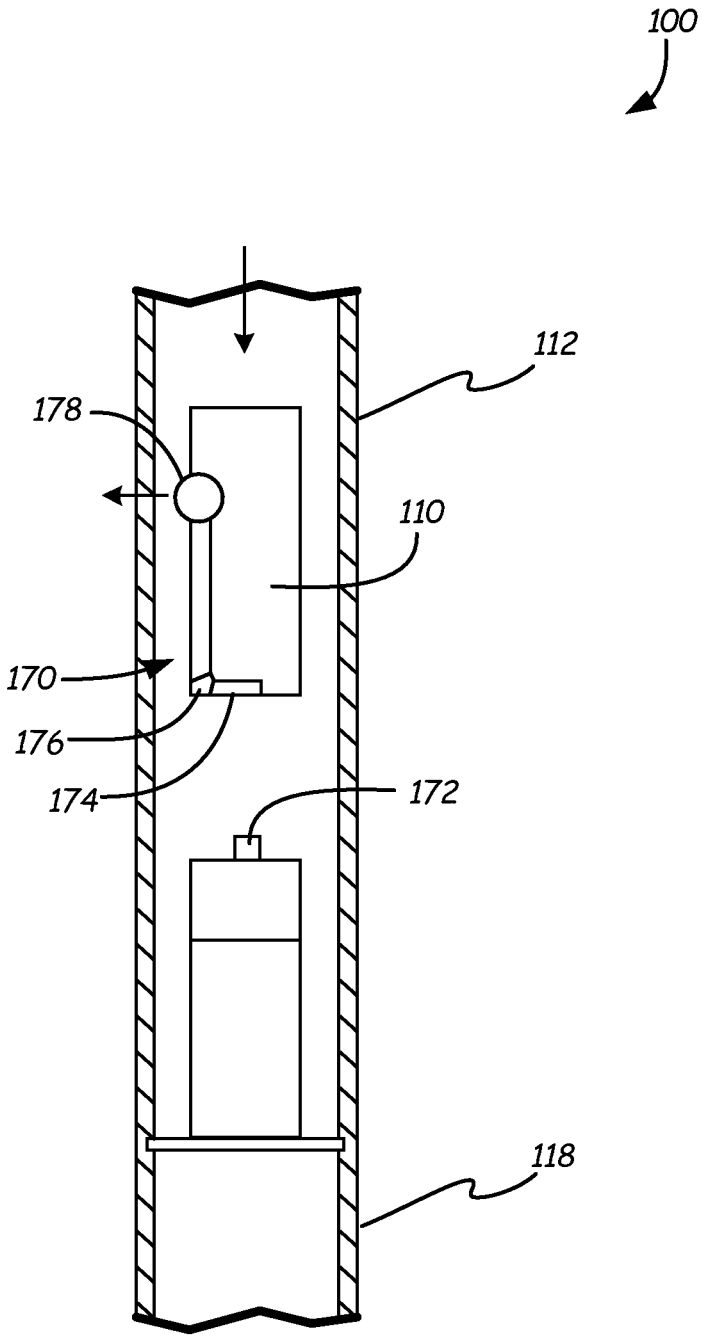
FIG. 3 is a cross-sectional view of a bottom of the well of FIG. 1 illustrating an acoustic source in accordance with another embodiment of the present invention.

FIG. 2 is a cross-sectional view of the lower portion of well 100 in accordance with one example embodiment of the present invention. In FIG. 2, the plunger 110 is illustrated as moving downward toward the bottom 118 of well 100 within tubing 112. An acoustic source 160 is positioned at the bottom 118 of well 100. The acoustic source 160 operates similar to a bell or the like. A lower portion 164 of plunger 110 is arranged to strike the source 160 thereby causing the source to vibrate. In one configuration, the source 160 includes a "clapper" mechanism or the like which is actuated when the plunger 110 strikes the acoustic source 160. When the plunger 110 strikes the acoustic source 160, an acoustic signal is generated which propagates toward the top 116 of well 100. This acoustic signal can be carried toward the surface using any appropriate medium. However, the tubing 112 of the well 100 is particularly well-suited for carrying the acoustic signal. When the acoustic signal reaches the top 116 of the well 100, circuitry (discussed below in more detail) can be used to detect the signal and provide an indication that the plunger 110 has reached the bottom of the well and it may now be retrieved by opening the motor valve 120 shown in FIG. 1. FIG. 3 is a cross-sectional view of a lower portion of well 100 illustrating another example embodiment of the present invention. In FIG. 3, an acoustic source 170 is carried by plunger 110. When the plunger 110 reaches the bottom 118 of well 100, a projection 174 of the acoustic source strikes a projection 172 causing the source 170 to pivot about a hinge point 176. This action causes a distal end 178 to strike the tubing 112 thereby causing an acoustic signal to be generated in tubing 112 which travels to the surface for subsequent detection. In another example embodiment, a similar acoustic source is positioned at the bottom 118 of well 100 and configured to strike the tubing 112, or otherwise introduce an acoustic signal into the tubing 112.

Figure 4:
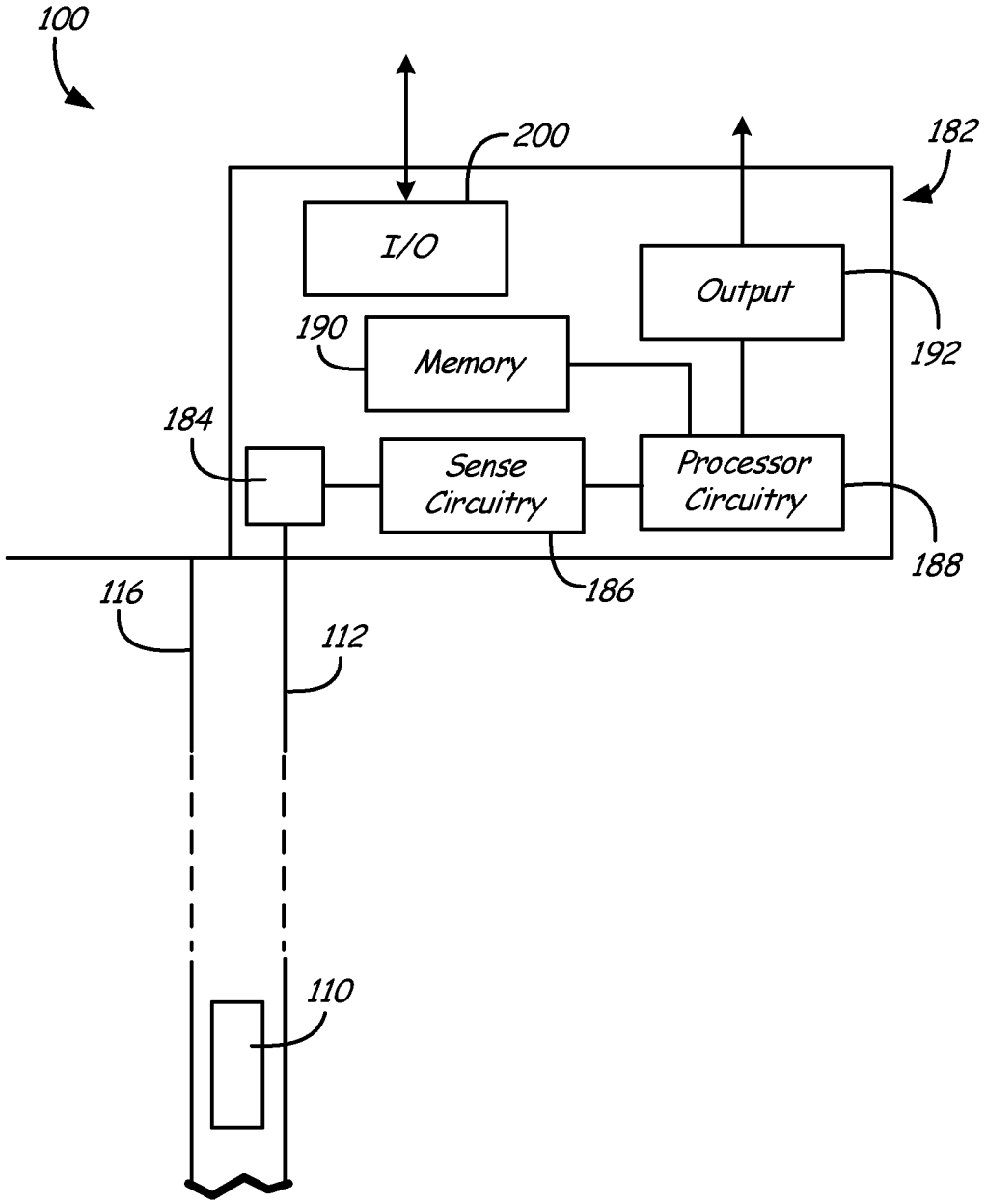
FIG. 4 is a simplified block diagram showing circuitry used to detect an acoustic signal generated by an acoustic source.

FIG. 4 is a simplified block diagram showing detection circuitry 182 positioned at the surface and coupled to well 100. Detection circuitry 182 includes an acoustic receiver or sensor 184 at the top 116 of well 100 configured to sense the acoustic signal generated when the plunger 110 reaches the bottom of the well 100. In FIG. 4, the acoustic receiver 184 is illustrated as being coupled to piping 112. In such a configuration, acoustic signals carried by piping 112 can be more efficiently received by the receiver 184. An output from the receiver 184 is provided to sensor circuitry 186 which may comprise, for example, an analog amplifier and/or filter. In one configuration, sensor circuitry 186 includes an analog to digital converter which provides a digital signal output representative of the received analog signal. Processor circuitry 188 receives the signal from the sensor circuitry 186. The processor circuitry 188 may comprise analog or digital circuitry. If digital circuitry is used, it can include a microprocessor which operates in accordance with instructions stored in a memory 190. For example, the received acoustic signal can be compared to wave forms stored in the memory 190, or can be detected based upon rules stored in memory 190. In another example configuration, processor circuitry 188 can comprise analog circuitry which compares the signal from the sense circuitry 186 to one or more threshold values and responsively provides an output to output circuitry 192. For example, a band pass filter can be implemented in sensor circuitry 186 such that only signals of a narrow frequency range are provided to process circuitry 188. This can be used to eliminate noise from other sources which may lead to a false detection that the plunger 110 has reached the bottom of the well 100.

When implemented in digital circuitry, the process circuitry 188 can be programmed by a user, or may include learning capabilities. For example, the processor can be placed in a learning mode in which it receives an acoustic signal when the plunger 110 reaches the bottom of the well 100. Information related to this received acoustic signal received during learning mode can be stored in the memory and used for subsequently detecting the plunger position. In a further embodiment, the detection circuitry 182 may receive information related to when the motor valve 120 shown in FIG. 1 is closed thereby indicating that the plunger 110 is being dropped down the well 100. This information can be used to initiate the detection sequence and cause the processor circuitry 188 to being monitoring output from the sensor circuitry 186 to detect when the acoustic signal from the plunger 110 when it reaches the bottom 118 of well 100. This information can also be used to help reduce falsely identifying the position of the plunger 110. For example, a timer can be started when the motor valve is closed whereby the processor circuitry must wait at least a certain amount of time before detecting that the plunger 110 has reached the bottom 118 of well 100. Similarly, if a time period greater than a certain amount has elapsed, the processor circuitry 188 can provide an output which indicates that the plunger 110 has reached the bottom 118 of well 100, even if an acoustic signal has not been detected. This allows the fluid within the well 100 to be extracted even in situations where the acoustic signal cannot be accurately detected.

Figure 5:
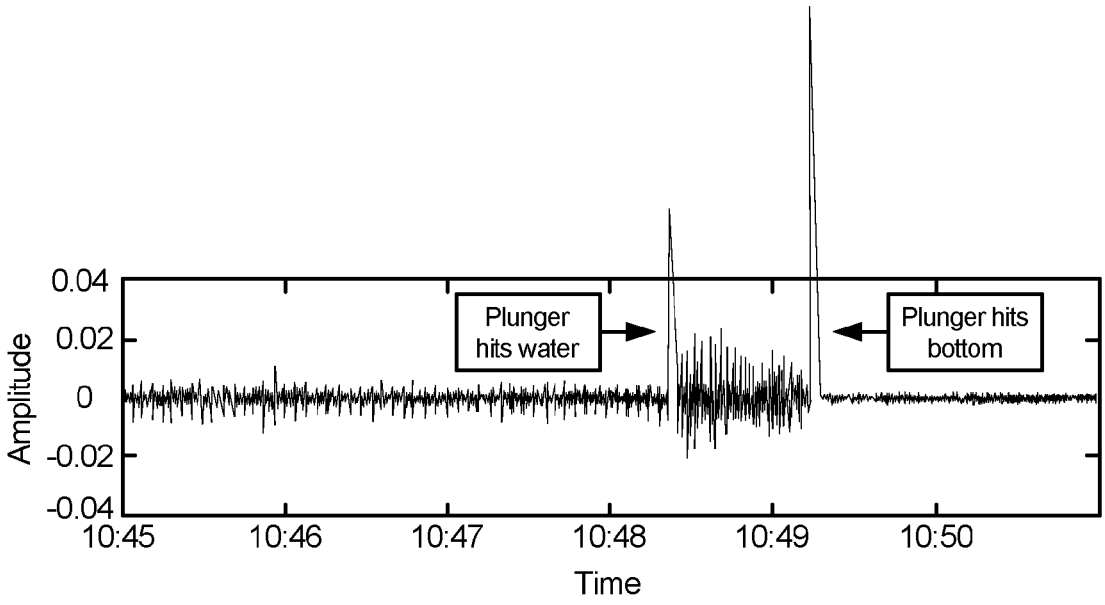
FIG. 5 is a graph of amplitude versus time of an acoustic signal generated by a plunger in a well.

FIG. 5 is a graph of amplitude versus time illustrating the received acoustic signal. The acoustic signal due to the acoustic source when the plunger 110 reaches the bottom of the well 100 causes a large spike in the received signal. This spike can be used to detect the position of the plunger 110 and is preferably significantly larger, or different in frequency, than other received signals such as the signal received when the plunger strikes water within the well 100.

The acoustic signal can be processed using any appropriate technique. Examples include simple threshold comparisons, as well as more complex techniques including monitoring one or more frequency of the received signal. Even more complex techniques include observing a particular signature in the reflected signal characteristic of the plunger reaching the bottom of the well. The detection technique can be implemented in analog and/or digital circuitry as appropriate. Detection of the plunger reaching the bottom of the well may, in some instances, need to be adjusted as the depth of the well increases. Similar adjustments may be made based upon the material surrounding the well, the material within the well, the particular well tubing used as well its configuration, etc. Referring back to FIG. 4, the output circuitry 192 can provide an output for use in controlling motor valve 120. The detection circuitry 182 may be embodied within the electronic controller 144 shown in FIG. 1, or may be a separate circuit which provides an output signal indicative of the plunger 110 reaching the bottom of the well to the electronic controller 144. The detection circuitry may also include additional input/output circuitry 200. For example, this additional circuitry can be used for providing a local output to an operator indicating the status of the plunger 110, or can be used to receive commands or queries from an operator. In other example embodiments, the output can be provided to a remote location. For example, information can be provided to a centralized location related to the position of the plunger 110. This information can be used for diagnostic purposes to ensure that the well 100 is operating within normal parameters. This output can be provided over a wired communication link, or can be provided using wireless technologies such as radio frequency communication techniques.

Although the present invention has been described with reference to preferred embodiments, workers skilled in the art will recognize that changes may be made in form and detail without departing from the spirit and scope of the invention. For example, the acoustic source is not limited to the particular embodiments discussed herein and can be any acoustic source which provides an acoustic signal when the plunger reaches a particular location within the well. Although a bottom location is specifically discussed, the invention is not limited to this configuration. In one specific example embodiment, the acoustic signal is generated using energy from the plunger as it drops into the well. However, in some configurations, it may be desirable to provide another energy source whereby electrical circuitry or other components can be powered. For example, the plunger may carry circuitry configured to provide an acoustic output when the plunger reaches a particular location within the well. Energy scavenging techniques may be employed to recharge a battery or the like within the plunger. For example, the energy generated as the plunger rises and falls within the well can be recovered and used to charge a battery. As used herein, the term "sense location" refers to the location at which the plunger position causes the acoustic source to generate an acoustic signal. In one configuration, the acoustic source comprises a mechanical mechanism and the acoustic signal is generated using only mechanical energy.

What is claimed is:

1. A system for identifying location of a plunger that moves along a length of a well, comprising:

an acoustic source carried in the well configured to transmit an acoustic signal when the plunger reaches a sense location in the well;

an acoustic receiver positioned at a top of the well configured to receive the acoustic signal; and processing circuitry configured to detect the received acoustic signal and provide an output indicative of the plunger reaching the sense location, wherein the acoustic source comprises a distal end mounted to a first projection at a pivot and wherein a second projection strikes the first projection causing the distal end to rotate about the pivot and strike a tubing of the well.

2. The system of claim 1 wherein the acoustic source is positioned at the sense location in the well and wherein the plunger contacts the acoustic source at the sense location thereby causing the acoustic source to generate the acoustic signal.

3. The system of claim 2 wherein the plunger strikes the acoustic source at the sense location.

4. The system of claim 1 wherein the acoustic signal is generated with energy from movement of the plunger.

5. The system of claim 1 wherein the well includes the tubing which extends from a surface to the sense location and wherein the acoustic signal is carried by the tubing.

6. The system of claim 5 wherein the acoustic source strikes the tubing when the plunger reaches the sense location.

7. The system of claim 1 wherein the acoustic source is carried by the plunger.

8. The system of claim 1 wherein the processing circuitry is configured to identify the acoustic signal in the presence of noise.

9. The system of claim 1 wherein the processing circuitry is configured to enter a learning mode to thereby learn to identify the acoustic signal.

10. The system of claim 1 wherein the processing circuitry controls operation of a motor valve of the well.

11. The system of claim 1 wherein the sense location is positioned to indicate the plunger arriving at a bottom of the well.

12. The system of claim 1 wherein the sense location is positioned to indicate the plunger at a water level in the well.

13. The system of claim 1 wherein the acoustic source includes electrical circuitry.

14. The system of claim 1 wherein the processing circuitry provides the output indicative of the plunger reaching the sense location further based upon time.

15. A method in a well for identifying location of a plunger that moves along a length of the well, comprising:

allowing the plunger to move within the well;

providing an acoustic signal from an acoustic source when the plunger reaches a sense location in the well, the acoustic source positioned at the sense location;

receiving the acoustic signal at a top of the well; and determining position of the plunger based upon the received acoustic signal;

wherein the acoustic source comprises a distal end mounted to a first projection at a pivot and wherein a second projection strikes the first projection causing the distal end to rotate about the pivot and strike a tubing of the well.

16. The method of claim 15 wherein the acoustic source is positioned at the sense location in the well and including contacting the acoustic source with the plunger at the sense location thereby causing the acoustic source to generate the acoustic signal.

17. The method of claim 16 wherein the plunger strikes the acoustic source at the sense location.

18. The method of claim 15 including generating the acoustic signal with energy from movement of the plunger.

19. The method of claim 15 wherein the well includes the tubing which extends from a surface to the sense location and including carrying the acoustic signal through the tubing.

20. The method of claim 19 wherein the acoustic source strikes the tubing when the plunger reaches the sense location.

21. The method of claim 15 wherein the acoustic source is carried by the plunger.

22. The method of claim 15 including identifying the acoustic signal in the presence of noise.

23. The method of claim 15 including entering a learning mode to thereby learn to identify the acoustic signal.

24. The method of claim 15 including controlling operation of a motor valve of the well.

25. The method of claim 15 wherein the sense location comprises a location proximate to a bottom of the well.

26. The method of claim 15 wherein the sense location comprises a location proximate to a water level in the well.

27. The method of claim 15 including determining position further based upon time.

* * * * *